United States Patent [19]

Puma

[11] Patent Number: 4,723,672

[45] Date of Patent: Feb. 9, 1988

[54] TAMPER-PROOF CONTAINER FOR MEDICAMENTS AND THE LIKE

[76] Inventor: John Puma, 19 Rolling Hill Way, Clark, N.J. 07066

[21] Appl. No.: 940,279

[22] Filed: Dec. 10, 1986

[51] Int. Cl.[4] ..... B65D 41/34

[52] U.S. Cl. ..... 215/228; 215/33; 215/250; 215/DIG. 7; 220/257; 220/258

[58] Field of Search ..... 141/380, 381; 215/228, 215/DIG. 7, 253, 250, 251, 256, 33, 35, 32; 220/257, 258

[56] References Cited

U.S. PATENT DOCUMENTS

| | | | |
|---|---|---|---|
| 2,374,092 | 4/1945 | Claser | 141/380 X |
| 3,434,620 | 3/1969 | Laurizio | 220/258 |
| 3,902,619 | 9/1975 | Gouget | 215/33 |
| 4,519,513 | 5/1985 | Weiler et al. | 215/250 X |

*Primary Examiner*—Donald F. Norton

*Attorney, Agent, or Firm*—Anthony F. Cuoco

[57] ABSTRACT

A tamper-proof container for medicaments or the like includes a receptacle and a cap, each featuring self-locking means so that when mutually engaged the container can only be accessed by changing its profile. Two external components, a guard and a shield, respectively, must be broken at their line of integration, and disengaged to provide access to a slot for parting the container at its neck. Such parting, provides access to a barrier which must be cut along a pre-scored line. The arrangement is such that the cap can be threadedly engaged with the receptacle to store a medicament dosage cup and includes a sanitation cover.

10 Claims, 9 Drawing Figures

FIG. 1
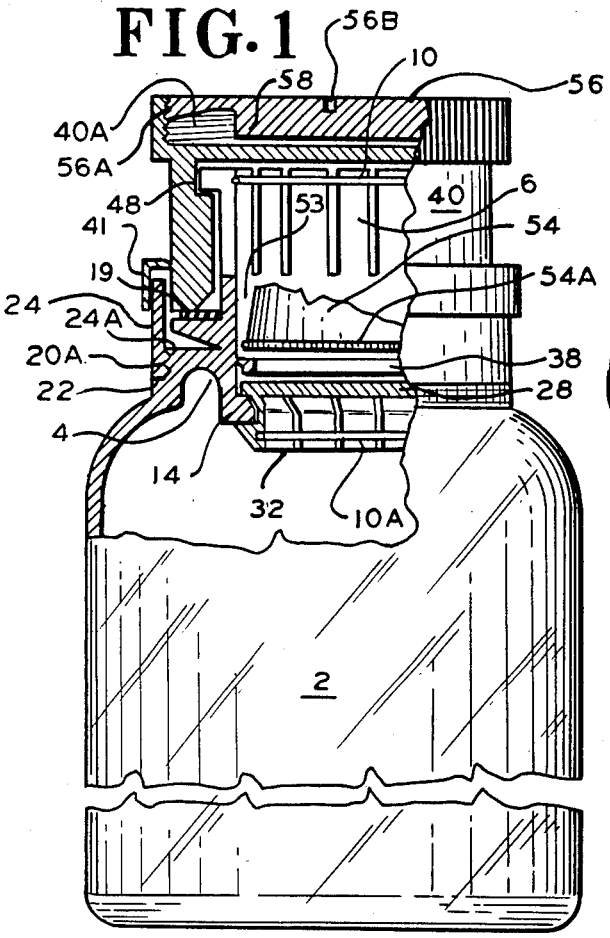
FIG. 9
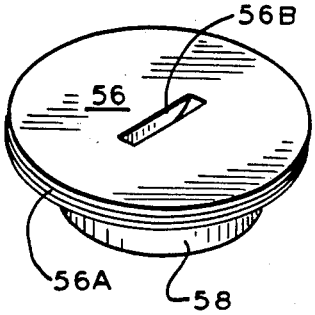
FIG. 3
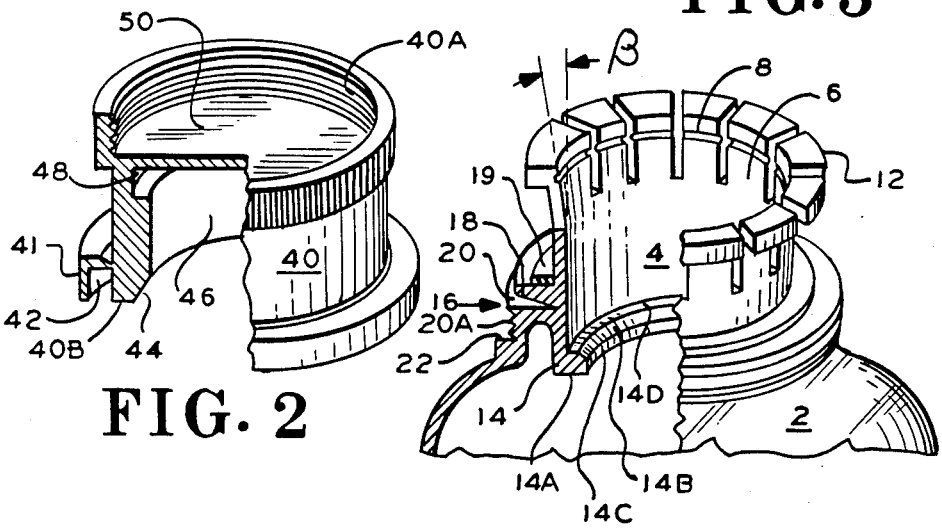
FIG. 2

TAMPER-PROOF CONTAINER FOR MEDICAMENTS AND THE LIKE

BACKGROUND OF THE INVENTION

This invention relates to a tamper-proof container for medicaments and the like whereby the medicaments are rendered safe from malicous adulteration as may be injurious to the consumers of the medicaments.

Recent incidents involving the injurious and indeed deadly tampering of "off-the-shelf" marketed medicaments have received wide notoriety. These incidents have resulted in the withdrawal of otherwise beneficial medicaments from the market, or changing the marketing status of these medicaments to a controlled basis thereby increasing their cost to the consumer. Manufacturers of these products have devoted large amounts of time and money to solve this insidious problem, but their efforts have so far met with less than desirable success.

Attempts have been made to provide "tamper-resistant" containers to prevent the aforenoted malicious adulteration. However, these attempts appear to have merely shifted the burden to the consumer to be extremely alert and observing so as to discern tampering indications. In short, while prior art containers purport to be tamper-resistant and/or tamper-proof, they are not as yet tamper-proof as to satisfy the need which so urgently exists.

In this regard the applicant is aware of the following prior art: U.S. Pat. No. 4,174,238 issued to Fowles, et al on Nov. 13, 1979; U.S. Pat. No. 4,426,004 issued to Hoag on Jan. 17, 1984; U.S. Pat. No. 4,445,622 issued to Sidiri on May 1, 1984; U.S. Pat. No. 4,453,636 issued to Meadows, et al on June 12, 1984; and U.S. Pat. Nos. 4,478,342, 4,478,341 and 4,478,343 issued to Slater, et al, Rangaswomy and Ostowsky, respectively, on Oct. 23, 1984.

Accordingly, it is the object of this invention to provide a virtually tamper-proof container for medicaments and the like so that the medicaments may be safely marketed, with the consumers having maximum assurance that the medicaments have not been maliciously and surreptitiously adulterated so as to cause harmful results.

SUMMARY OF THE INVENTION

This invention contemplates a tamper-proof container for medicaments and the like including a protected receptacle which contains the medicaments. The receptacle includes a ledge, which accommodates a security barrier having a pre-scored knock-out trace for providing a suitable opening to the protected receptacle. Upon engagement of the security barrier with the ledge, via preloading with a suitable tension member, the security barrier cannot be removed without destruction of it or the receptacle. A security barrier guard is provided to insure that the barrier is not forcibly removed and surreptitiously replaced with another barrier. The receptacle also includes a plurality of fingers arranged with a tension ring. The fingers are integral to a common base and are directed upwardly and slightly outwardly. Each finger has an integral outwardly projecting member with a surface for engaging in snap-fit relation a lock slot in a receptacle cap. The arrangement is such that when the cap is displaced downwardly with respect to the receptacle the cap engages the fingers causing said fingers to deflect inwardly and to glide on an inner and least diameter surface of the cap, until said members find and snap into the cap lock slot. A cup is arranged with the cap for containing a daily dosage of medicaments as may be desired.

BRIEF DESCRIPTION OF THE DRAWING

FIG. 1 is a partially sectioned, cut-away elevation view showing the container of the invention in a closed tamper-proof mode and further showing the the several components thereof in their respective structural relationships.

FIG. 2 is a partially sectioned cut-away pictorial representation best showing a container cap.

FIG. 3 is a partially sectioned, cut-away pictorial representation best showing a container neck.

FIG. 9 is a pictorial representation of the sanitation cover for use in conjunction with the container cap.

DETAILED DESCRIPTION OF THE INVENTION

Figure 4:
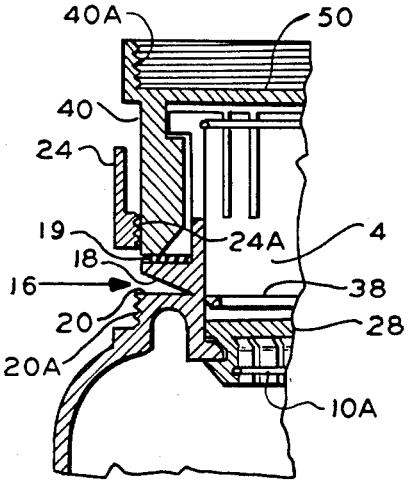
FIG. 4 is a sectioned partial elevation view showing the container with a shield in a lifted position for access to a parting slot.

With reference to the several Figures in the drawing, wherein corresponding elements carry corresponding numerical designations, and with particular reference first to FIGS. 1 and 3, the invention is seen as including a receptacle portion 2 for pills, capsules or other medicaments, and terminating in a neck base 4 having integral therewith a plurality of fingers 6 as best shown in FIG. 3. Fingers 6 extend circumferentially around neck base portion 4 and lean slightly outward therefrom by an angle $\beta$.

A tension ring groove 8 (FIG. 3) extends circumferentially around the inner surface of fingers 6 near the top thereof. Groove 8 carries a tension ring 10 (FIG. 1) of the type shown in FIG. 7, and which tension ring exerts an outward force as will be understood by those skilled in the art. Fingers 6 terminate at their tops in radially and outwardly extending projections 12 (FIG. 3).

With specific reference to FIG. 3, a ledge 14 is integral with the lower and inner portion of neck base 4. A cut-in slot 16 (FIGS. 3 and 4) is integral with the central and outer portion of neck base 4. Slot 16 has an upper limiting guide 18 carrying a resilient cap ring seal 19. Slot 16 also has a lower limiting guide 20 having external, circumferentially extending threads 20A extending downward to a receptacle outer ledge shield stop 22.

The diameters of lower limiting guide 20 and outer ledge shield stop 22 are each respectively and progressively slightly greater than the diameter of upper limiting guide 18. An annular, cylindrical shield 24 having a partial thread 24A on its inner surface is in complete threaded engagement with threads 20A on lower limiting guide 20 and is homed to shield stop 22 (FIG. 1).

Figure 6:
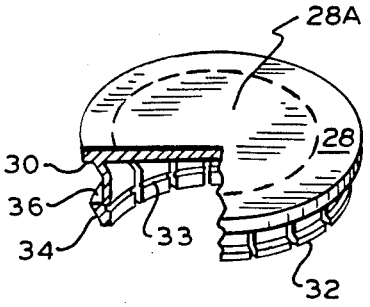
FIG. 6 is a partially sectioned pictorial representation best showing the security barrier referenced in FIG. 5 including a pre-scored line which must be completely cut for access to the medicaments in the container.

Referring particularly to FIG. 6, a security barrier 28 has a homing surface 30 and a plurality of fingers 32 extending circumferentially therearound. Across their inner surface and near their ends, fingers 32 have a circumferentially extending tension ring groove 33 for supporting a tension ring such as ring 10 shown in FIG. 7, and which tension ring exerts an outward force as aforenoted.

As further shown in FIG. 6, security barrier fingers 32 have a ramp 34 and a grappling surface 36. The top of security barrier 28 has a pre-scored circular line defining an area 28A.

Figure 5:
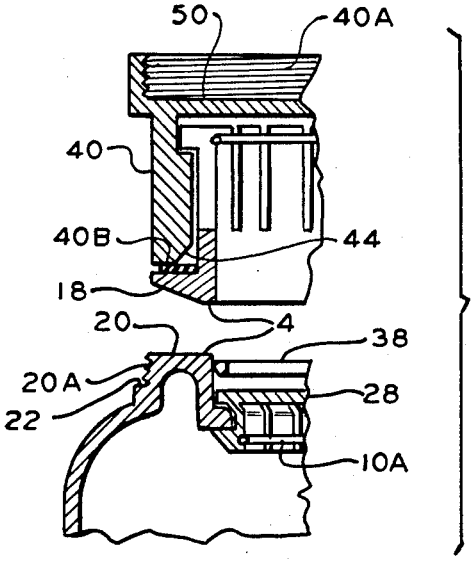
FIG. 5 is a sectioned partial elevation view showing the container with a cover removed, and parted for access to a guard ring and a security barrier, and with the shield referenced in FIG. 4 removed for ultimately engaging the cap with the container neck.

As shown in FIGS. 4 and 5, a frangible guard ring 38 is circumferentially melded to the inner surface of neck base 4, above security barrier 28 and below the elevation of cut-in slot 16 as indicated by the elevation of lower limiting guide 20.

With particular reference to FIGS. 1 and 2, a cap 40 has an external shield guard 41 including a cavity 42 extending circumferentially therearound, and of such construction so as to be weakest at its junction with the cap. Cap 40 has a ramp 44, an internal glide surface 46, a lock slot 48, a barrier 50 and an internal thread 40A. When cap 40 is fitted over fingers 6 to full closure, a lower surface 40B of the cap (FIG. 2) contacts resilient seal 19 (FIG. 1), whereby a cavity 53 is formed for storing a medicament dosage dispensing cup 54 as shown in FIGS. 1 and 8.

With reference to FIGS. 1 and 9, a sanitation cover 56 has a coin slot or the like 56B, and externally threaded diametrical edge 56A, and a smaller diameter downwardly projecting section 58. Threaded edge 56A engages cap thread 40A when the container is in the tamper-proof mode. An under surface 60 (FIG. 8) limited from the smaller diameter projection 58 and to the larger threaded diameter edge 56A, is contoured to mate with the contour formed by neck base portion 4 and upper limiting guide 18 (FIGS. 5 and 8) when neck base portion 4 is circumferentially parted at cut-in slot 16 as best shown in FIG. 5. The diameter of section 58 (FIG. 9) is such as to slip-fit into the inner diameter of the now partial remnant of neck base portion 4 (FIG. 8) resulting from the aforenoted parting.

Figure 8:
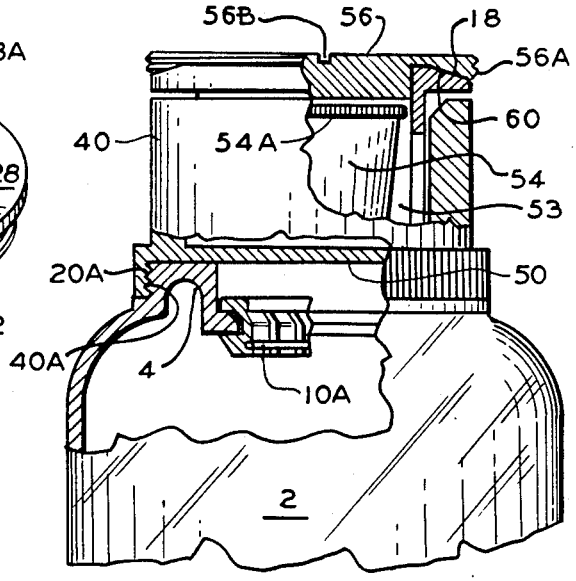
FIG. 8 is a partially sectioned cut-away elevation view showing the container of the invention after parting as referenced in FIG. 5, but with the cap inverted, and including a dosage cup and a sanitation cover.

FIG. 8 further illustrates receptacle portion 2 with neck base portion 4 following the parting of the neck base portion into two sections, and further showing cap thread 40A in threaded engagement with neck base thread 20A when cap 40 is inverted from its position shown in FIGS. 1, 4 and 5.

FIG. 1 best shows the tamper-proof container of the invention following procurement and prepared for opening and subsequent access to the medicaments therein. An initial complete visual observation should be made by the user, including observing cap barrier 40 for evidence of drill-through and redressing and an observation of shield guard 41 to ensure that it is not broken away from cap 40. To open the container it is necessary to strike shield guard 41 to break it cleanly at its juncture with cap 40, and to raise shield 24 to access cut-in slot 16 (FIG. 4).

Threads 20A and 24A are completely disengaged by turning shield 24 and sliding shield guard 41 and shield 24 upward, surrounding cap 40.

A suitable knife or the like is used to cut neck base 4 entirely across at cut-in slot 16, within the limits provided by lower limiting guide 20 and upper limiting guide 18 with the result being as shown in FIG. 5.

A visual inspection is made of security barrier ring guard 38 and security barrier 28 shown in FIG. 5. Ring guard 38 is broken off and a suitable knife or the like is used to cut pre-scored area 28A of security barrier 28 (FIG. 6), whereupon the central portion 28A of the security barrier 28 is removed for access to the medicaments in the container.

Cap 40 is inverted with all of the remnants locked therein from the prior parting and secured to neck base 4 via threads 20A and 40A as shown in FIG. 8. Cup 54 is oriented within cavity 53 and the resultant opening is closed with cover 56 as also shown in FIG. 8.

Figure 7:
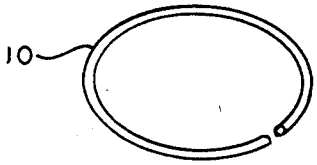
FIG. 7 is a pictorial representation best showing a tension ring of the type used in the invention.

FIG. 3 best shows the tamper-proof container of the invention at the time of medicament loading. A tension ring 10A such as ring 10 shown in FIG. 7 is secured into security barrier ring groove 33 (FIGS. 5 and 6). Security barrier 28 (FIG. 6) is lowered into neck base portion 4 (FIG. 3) causing ramps 34 of fingers 32 (FIG. 6) to glide onto ledge ramp 14B (FIG. 3) and continuing to glide on surface 14C until the finger ends leave contact with the vertical surface of the ledge, at which time all of the fingers 32 (FIG. 6) deflect outwardly due in part because of their normal tension and also because of the tension supplied by tension ring 10A in groove 33. Fingers 32 grapple undersurface 14A of ledge 14 and cause security barrier homing surface 30 to securely contact a ledge homing surface 14D as shown in FIG. 3. As shown in FIG. 1, and as aforenoted, guard ring 38 is circumferentially melded to neck base 4 above security barrier 28 and below the elevation of cut-in slot 16 (FIG. 4). Cup 54 is disposed in cavity 53, preferably with its rim 54A downward as shown in in FIG. 1.

Resilient seal 19 is disposed on the top surface of upper limiting guide 18 as particularly shown in FIG. 4. Shield threads 24A and neck base threads 20A are engaged until the shield is homed to shield stop 22 (FIGS. 3 and 5). A tension ring 10A such as tension ring 10 shown in FIG. 7 is secured in tension ring groove 8 (FIGS. 1 and 3).

Cap 40 is disposed so that ramp 44 (FIGS. 2 and 3) contacts the upper edges of fingers 6. The cap is continuously moved relatively downward causing the finger edges to glide on ramp surface 44 and then to glide on inner cap surface 46 until the finger edges just pass the lower edge of slot 48 best shown in FIG. 2. At this time the finger projections aided by their own outward inclination 8 and further aided by tension ring 10 in tension ring groove 8 snap into slot 48. Also, at this time, a sealing edge 40B of cap 40 (FIG. 5) surfaces on seal 19 (FIG. 1). Cover 56 is disposed so that threads 56A thereof engage cap threads 40A upon a turning force being applied by a coin or the like inserted in coin slot 56B best shown in FIG. 9.

With the above description of the invention in mind reference is made to the claims appended hereto for a definition of the scope of the invention.

What is claimed is:

1. A tamper-proof container, characterized by:

a receptacle portion for containing contents in the container and terminating in a neck portion, said neck portion having one end near the receptacle portion and an opposite end extending beyond said receptacle portion;

an integral, internal ledge extending circumferentially around the receptacle portion near the one end of the neck portion;

a security barrier supported by the ledge, said security barrier having a removable pre-scored knock-out area;

means for exerting an outward force on the security barrier;

a frangible, removable guard ring internal to and integral with the neck portion, and disposed above the security barrier;

the neck portion including a plurality of circumferentially disposed fingers extending from a common base near the one end of the neck portion and terminating at the opposite end thereof in integral, outwardly projecting members having radially disposed outer surfaces;

means for exerting an outward force on the fingers near the outwardly projecting members;

an invertable cap disposed over the plurality of fingers and including an internal, circumferentially extending slot for receiving the radially disposed outer surfaces of the outwardly projecting finger members having the outward force exerted thereon when the cap is displaced along the neck portion toward the receptacle portion;

the receptacle portion having an external, circumferentially extending threaded area near the one neck portion end and a cut-in slot beyond said threaded area and near said one neck portion end; and a shield having an internal circumferentially extending area in threaded engagement with the externally threaded receptacle portion area for inhibiting access to the cut-in slot.

2. A tamper-proof container as described by claim 1, further characterized by:

the cap including a guard extending circumferentially therearound and including a cavity; and the guard cavity receiving the shield when the shield area is in threaded engagement with the receptacle portion area for inhibiting access to the cut-in slot.

3. A tamper-proof container as described by claim 1, further characterized by:

the receptacle portion having a guide member beyond the cut-in slot and near the one neck portion end;

a resilient seal carried by the guide member; and the cap having one end including a sealing edge adjacent the resilient seal when the cap is displaced so that the slot thereof receives the radially disposed outer surfaces of the preloaded outwardly projecting finger members; and said cap having an opposite end including an internal, circumferentially extending threaded area.

4. A tamper-proof container as described by claim 3, further characterized by:

a cover having an external circumferentially threaded outer edge, and a section projecting away from said outer edge; and the internal threaded area of the cap being in threaded engagment with the external threaded outer edge of the cover.

5. A tamper-proof container as described by claim 4, characterized by:

the externally threaded receptacle portion and the internally threaded shield being disengaged when the shield is rotatably displaced, whereupon the shield and guard are urged to slide away from the receptacle portion to surround the cap and to expose the cut-in slot.

6. a tamper-proof container as described by claim 5, further characterized by:

the neck portion being adapted to be cut across by access through the exposed cut-in slot, whereupon the receptacle portion with the security barrier and frangible guard ring can be separated from the neck portion with the cap and cover.

7. A tamper-proof container as described by claim 6, further characterized by:

the frangible, removable guard ring and the removable pre-scored knock-out area removed for providing an opening in the receptacle portion to permit access to the contents in the container.

8. A tamper-proof container as described by claim 7, further characterized by:

the invertable cap being inverted upon removal of the guard ring and the knock-out area;

said inverted cap and receptacle portion being thereupon threadingly engaged via the external threaded receptacle area and the internal threaded cap area; and the cover section projecting away from the threaded cover outer edge being thereupon received in slip fit relation by the cap.

9. A tamper-proof container as described by claim 3, further characterized by:

the one cap end including a sealing edge adjacent the resilient seal, whereupon a cavity is provided; and a dispensing cup being stored in the cavity for dispensing the contents in the container.

10. A tamper-proof container as described by claim 1, further characterized by:

the security barrier including a plurality of circumferentially disposed fingers extending away from the pre-scored knock-out area and toward the receptacle portion, and the ends of said fingers forming a grappling surface; and the outward force exerted on the security barrier affecting said fingers so that the grappling surface formed by the ends of said fingers grapples the underside of the ledge which supports the security barrier, with the security barrier thereupon being in a homing position on the ledge.

* * * * *